US006928975B2

(12) United States Patent
Lauritsen

(10) Patent No.: US 6,928,975 B2
(45) Date of Patent: Aug. 16, 2005

(54) DOSING SYSTEM

(75) Inventor: Sven Lauritsen, Svenstrup (DK)

(73) Assignee: Hans Jensen Lubricators A/S, Hadsund (DK)

( * ) Notice: Subject to any disclaimer, the term of this patent is extended or adjusted under 35 U.S.C. 154(b) by 197 days.

(21) Appl. No.: 10/399,953

(22) PCT Filed: Oct. 24, 2001

(86) PCT No.: PCT/DK01/00702

§ 371 (c)(1),
(2), (4) Date: Jul. 22, 2003

(87) PCT Pub. No.: WO02/35068

PCT Pub. Date: May 2, 2002

(65) Prior Publication Data

US 2004/0026174 A1 Feb. 12, 2004

(30) Foreign Application Priority Data

Oct. 24, 2000 (DK) ..... 2000 01584

(51) Int. Cl.[7] ..... F01M 1/08
(52) U.S. Cl. ..... 123/196 R; 123/1 A
(58) Field of Search ..... 123/196 R, 1 A

(56) References Cited

U.S. PATENT DOCUMENTS 4,458,643 A * 7/1984 Isobe et al. ..... 123/196 R

FOREIGN PATENT DOCUMENTS

| | | | |
|---|---|---|---|
| CH | 673506 | | 3/1990 |
| DE | 3044255 | | 6/1982 |
| DK | 155757 | * | 5/1989 |
| EP | 0520659 | | 12/1992 |
| GB | 1285651 | * | 8/1972 |
| WO | WO91/03640 | | 3/1991 |
| WO | WO 91/03640 | * | 3/1991 |
| WO | WO92/20909 | | 11/1992 |
| WO | WO99/22133 | | 5/1999 |

* cited by examiner

*Primary Examiner*—Henry C. Yuen
*Assistant Examiner*—Jason Benton
(74) *Attorney, Agent, or Firm*—James Creighton Wray; Meera P. Narasimhan

(57) ABSTRACT

There is described a dosing system for cylinder lubrication oil for large diesel motor cylinders, e.g., in marine engines. The system has a supply pipe and a return pipe provided with each their valve (3, 27), and which are connected with a central supply pump. This comprises a number of injection units that are connected with the said pipes. Each unit comprises an injection nozzle for injecting atomized cylinder lubricating oil into an associated cylinder, a piston (1) provided at a rearmost part of the nozzle rod, and a controllable motor (37) which via a screw (33) is connected with the piston (1) in order thereby to adjust the pump stroke of the piston (1). Futhermore, the system comprises a central computer for controlling the valves (3, 27) and the motor (37) so that precise control of the amount of oil and precise timing are achieved.

8 Claims, 3 Drawing Sheets

DOSING SYSTEM

This application claims the benefit of Danish Application No. PA 2000 01584 filed Oct. 24, 2000 and PCT/DK01/00702 filed Oct. 24, 2001.

BACKGROUND OF THE INVENTION

The present invention concerns a lubricating system for large diesel engines wherein the cylinder lubricating oil is applied to the cylinder surface through a number of nozzles as a mist of oil droplets. A system of this type is known e.g. from WO 00/28194.

The oil supply to individual nozzles occurs by means of a conventionally timed lubricating apparatus from which small piston pumps sends sized portions of oil out to each their nozzle through a valve.

One lubricating apparatus supplies one engine cylinder, or a group of engine cylinders, and is often driven directly by the diesel engine and synchronously with it as the mentioned oil portions are to be dosed to the cylinder surface with timing, i.e. at certain points of time. The lubricating apparatus is usually placed at some distance from each individual point of lubrication. In very long pipes, the compressibility of the oil has a decisive influence on the precision of the dosing. Even though experience with the system has shown that in pipe lengths up to 6–7 meters no great deviations in dosing precision seemingly occur, it is always an advantage with as short pipe lengths as possible between the unit determining the dosing amount and the timing and the point of dosing, upon the cylinder wall.

Not all diesel engines enable direct mechanical driving of the lubricating apparatus synchronously with the number of revolutions. Furthermore, there is an increasing need for a flexible and easy adapting of the dosed cylinder lubricating oil amount for the actual immediate need of the engine, depending on diverse measurable engine parameters. It is also desirable continuously to adapt the timing according to the actual operating situation in a flexible way. All these adaptations are preferably to be controlled centrally.

Driving the lubricating apparatuses synchronously with the engine rpm is possible electronically but is comprehensive and costly. The timing may be immediately changed with such a system.

As the cylinder lubricating oil is to be dosed with one portion per motor revolution, the only possibility for adjusting the dosing is to change the stroke of the pumps. A system for this is described in DK patent application 4999/85. This system is using a cam mechanism for adjusting the pump stroke in dependence of the motor load. Change in this dependence may only occur by exchanging the cams with new cams with another transformation function.

It has also been suggested to adjust the pump stroke by means of a controllable motor, e.g. a step motor. This has been used for point lubrication but the latter is only implemented with difficulty in connection with conventional lubricating apparatuses.

In connection with traditional cylinder wall lubrication, it has been practice until now to use simple spring biased check valves which can resist the internal pressure in the cylinder but are yielding to a slightly higher external injection pressure. In connection with the invention it is desirable and necessary that the valve system only opens at a much higher oil pressure in order that the oil injection from the beginning can assume the character of an atomising injection. It concerns a pressure difference factor of up to several hundred percent.

SUMMARY OF THE INVENTION

It is the purpose of the present invention to provide a system for spray lubrication of cylinders in large diesel engines whereby it is possible to achieve a flexible central control of pump stroke and thereby amount of oil in addition to precise control of timing.

This is achieved according to the present invention with a dosing system with a supply pipe and a return pipe provided with each their valve and connected with a central supply pump, and with a number of injection units corresponding to the number of cylinders in the engine and connected with the pipes, each of which units comprising:

- an injection nozzle for injecting atomised cylinder lubricating oil into an associated cylinder,
- a piston placed at the rear end of a nozzle rod, and
- a controllable motor abutting on the piston via a screw in order thereby to adjust the pump stroke of the piston, which system also comprises
- a central computer for controlling the valves and the motor.

With this system, the stroke may easily be adjusted by setting the controllable motor. This is done centrally by the computer from received data about the operating parameters of the motor. Also, the opening and closing of the valves may be controlled by the computer. With the system according to the invention, it is thus possible that the operating parameters of the motor are transformed to change in timing and the amount of cylinder lubricating oil dosed. This oil may be dosed at the desired time in the operating cycle of the motor. Since a spray is injected, a particularly effective lubrication of the engine is enabled.

In a cylinder there may be one or more injecting units. Usually, the number of injection units will be multiples of the number of cylinders.

According to a particular embodiment of the invention, the system is peculiar in that the nozzle comprises a cylindrical nozzle rod for fitting through a hole in the cylinder wall, the nozzle rod having a central passage for a needle valve body which is spring loaded in outward direction for closing an inner valve seat in a nozzle outlet of the nozzle rod, and a second axial passage for controlled supply of pressurised oil to a front pressure chamber in which the pressurised oil may exert a backward pressing of the needle valve body for opening the inner valve seat as well as an overpressure injection of oil through the nozzle opened thereby until the oil pressure is lowered for effective closing of the needle valve, where the central passage is constituted by an annular cylindrical space between an outer tubular cylindrical nozzle rod and a centrally placed through-going pipe for central accommodation of the needle valve body.

According to the invention, there is used a valve controlled injection nozzle for injecting cylinder lubricating oil into large diesel engine cylinders. Hereby is achieved a desired atomisation as a far greater injection pressure is to be operated with than if the lubricating oil is only to flow in through lubricating holes in the cylinders.

Some nozzle valves, which are to work under corresponding conditions, are already known, namely diverse injection units for fuel for engine cylinders, but these prior art devices are not related to injection of cylinder lubricating oil and they are not immediately suited for this purpose as they will be arranged under other mounting conditions than those corresponding to insertion through a cylinder wall.

However, in connection with the invention it has been found attractive to base the new valve on certain basic features by these prior art fuel valves, namely primarily with reference to their appearance as round rods with a central passage for receiving a valve body with a front valve needle for interacting with a valve seat very close to the outer nozzle opening, and with a compression spring located behind for advancing the valve body and needle against the seat, and with a liquid duct for conducting pressurised fluid to a pressure compartment in front of the valve body, so that this, and thereby the valve needle, are pushed back when the required pressure is applied on the liquid. Hereby, the nozzle will be opened only when the high pressure is established, i.e. an atomisation of the liquid may occur immediately from the initiation of the valve opening and until the higher liquid pressure is reduced so much or so little that the pressure cannot any longer overcome the action of the mentioned compression spring, i.e. the atomisation will then stop abruptly while there is still a very large pressure on the liquid. From the said pressure compartment there will come a little rearward leaking liquid which then just may be discharged through the said central passage.

The fuel valves concerned may without any difficulties in principle be made and fitted in the cylinder heads of the engine with the required dimensioning of the said valve rods. Here it is a decisive condition that by this arrangement there is ample space for these rods to appear with the cross-sectional size needed for establishing the said central passage and the liquid supplying duct in parallel therewith, which in fuel valves have appreciable thickness.

In connection with valves for cylinder wall lubrication, the dimensioning and mounting conditions are completely different. It is crucial that the valve rod diameter is minimised as, particularly in existing engine cylinders, no breaking through with "lubricating holes" larger than initially presupposed is allowed, and these holes are in practice considerably smaller than the holes provided in the cylinder heads for passing through the fuel valves.

On this background, it will be advantageous for using the same technique for the cylinder wall lubrication that the liquid supply duct may here be appreciably narrower as a consequence of the necessary liquid supply here will only constitute a minor fraction of the fuel flow so that this will be to the advantage of a small diameter of the valve rod. In practice, however, the problem that it is very difficult to form a very thin duct through a relatively elongate rod body appears, particularly when this duct is to be located outside the central passage in the rod body. A direct application of the said prior art will thus imply either an unrealistic expensive making of a narrow rod body or an unacceptable great thickness of the rod body.

By the invention it has been realised that a radical change may be done to these circumstances by the decentralised liquid supply duct being arranged as an annular duct around the centre passage as one or more axial grooves, respectively, in the area between a central inner pipe and a surrounding rod pipe. By such a division into two pipes, there may, without any difficult cutting operation, be provided a narrow duct which may take up a minimum of space in the radial direction, and in practice it has appeared that it is possible to adapt the nozzle valves with so small thickness anyway that they are completely suited for the particular purpose described here.

DESCRIPTION OF THE DRAWING

The invention will now be explained below with reference to the accompanying drawing, in which.

Figure 1:
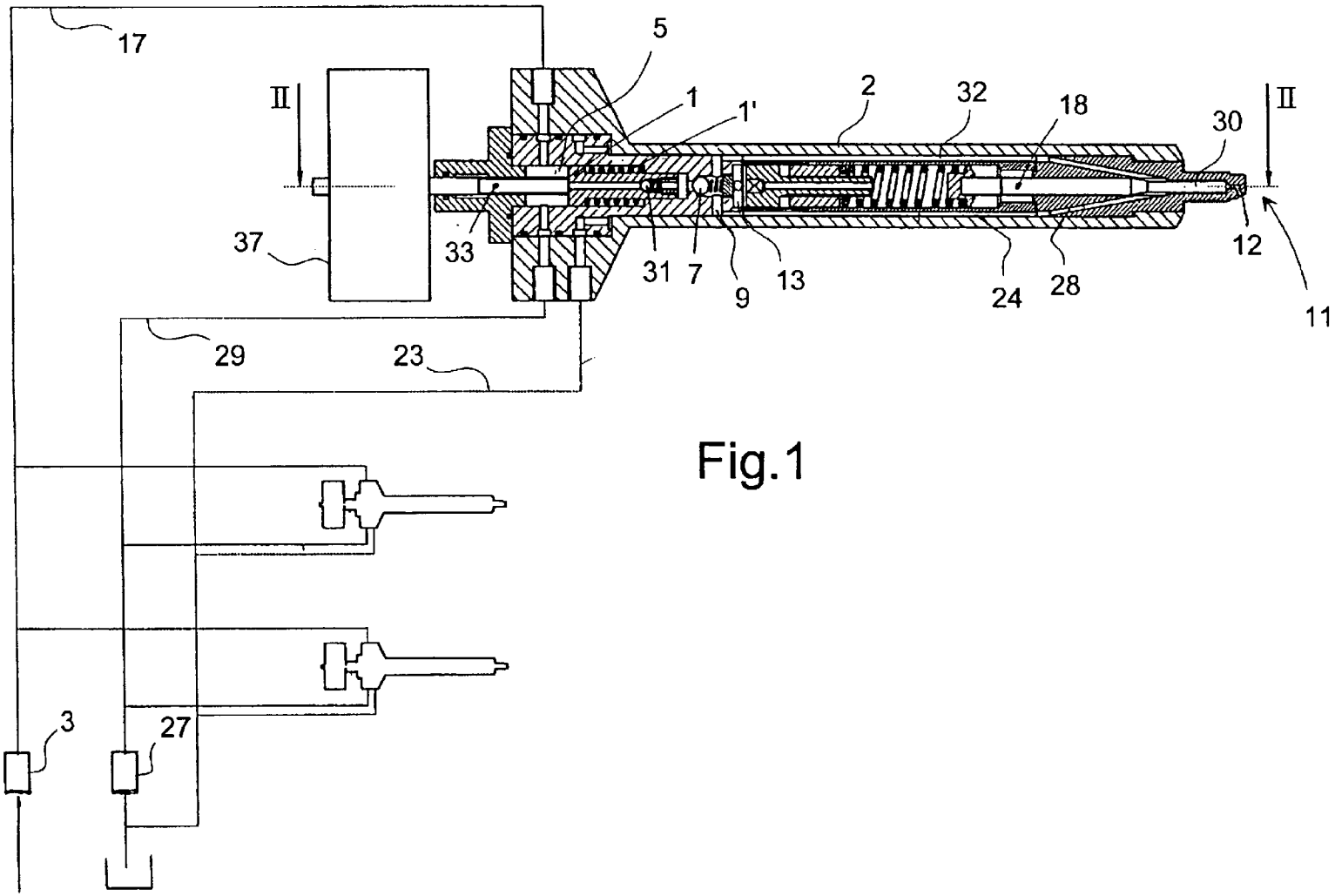
FIG. 1 shows a system according to the invention with three injection units.

The system according to the invention in FIG. 1 is shown as an installation with three injection units/valves, but the number is not limited to three. The injection unit comprises a dosing unit mounted directly on each single valve.

Figure 2:
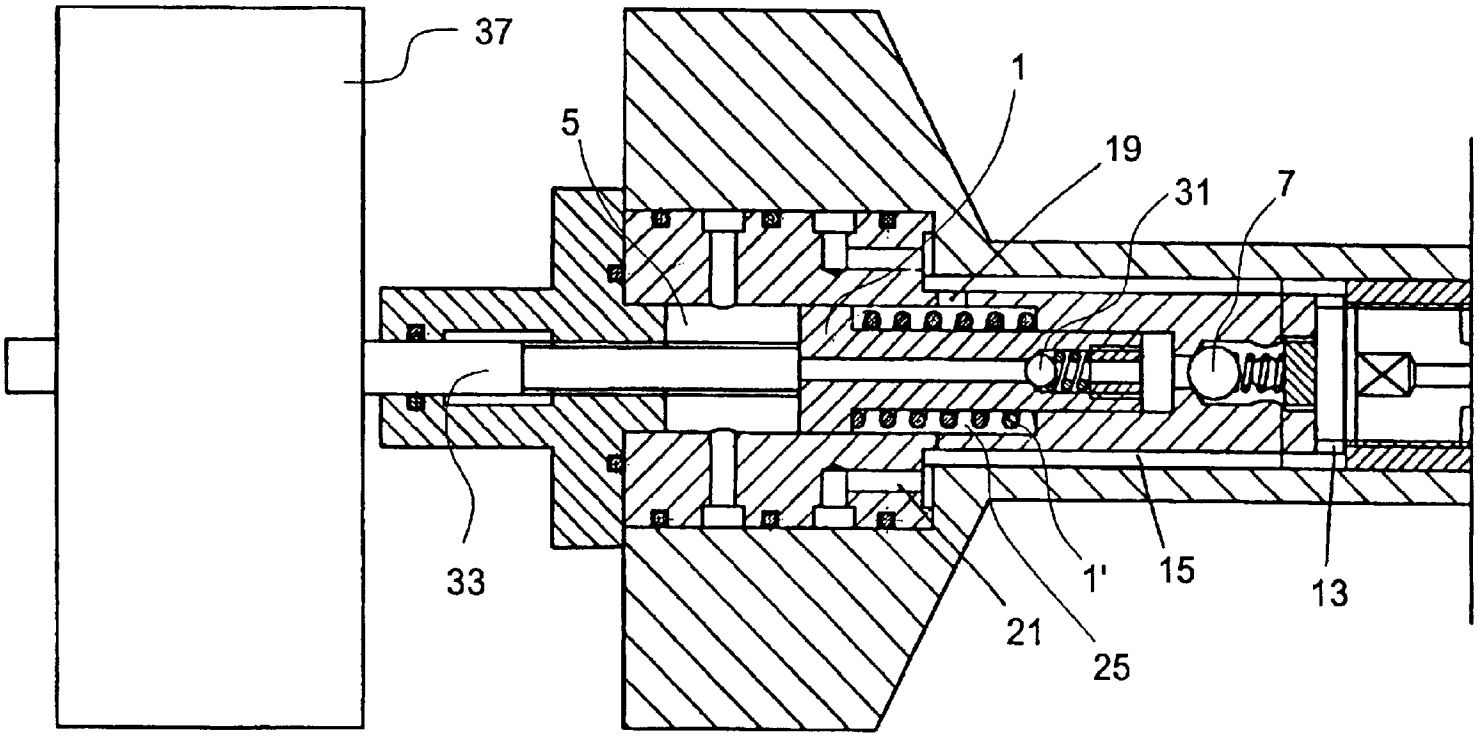
FIG. 2 shows a partial section in enlarged scale on the line II—II in FIG. 1 of an injection unit.

The dosing unit, more clearly shown in FIG. 2, consists of a piston 1 which may have a differential piston as shown. The piston is held to the left by the spring 1' when the system is without pressure. When the valve 3 is opened, the compartment 5 is supplied with pressurised oil from a pump, which is not shown here, via the pressure pipe 17 whereby the piston is moved to the right, and the oil displaced by the right end of the piston is led through the pressure valve 7 via the ducts 9, 24 and 28 to the compartment 30 before the nozzle needle 18 and further on through the nozzle duct 12 of the nozzle 11. The function of the valve is described more closely below.

The leak oil from the valve is conducted through the ducts 13, 15 and 21 to the return pipe 23. The compartment 25 around the spring 1' is in constant connection with the return pipe 23 through the hole 19 so that the varying oil volume in this compartment 25 does not disturb the function. When the piston 1 has reached its bottom position, the valve 27 is opened and the valve 3 is closed. Hereby the compartment 5 is connected with the return pipe 29, the spring 1' will force the piston 1 back to its extreme left position, and the compartment 5 is supplied with new oil through the suction valve 31 in the piston 1. The suction valve is not necessarily to be placed in the piston 1, the pump stroke is adjusted with the screw 33 which is turned by the controllable motor 37.

Opening and closing of valves 3 and 27 and controlling the motor 37 may occur centrally from a computer (not shown) receiving the operating parameters of the motor and transforming them to changes in timing and pump stroke, respectively.

The dosing unit described is not necessarily to be mounted on each single nozzle unit but may e.g. be mounted assembled with the dosing units for the other nozzle units for a cylinder so that the stroke adjustment may be performed by one single motor 37 for all dosing units. The dosing unit is then connected to the valves in the cylinder wail by means of pipe connections. As the dosing units were small compared with a conventional lubricating apparatus, the dosing units coupled together may be mounted at any place close to the points of lubrication without incurring the limitations implied with the larger conventional lubricating apparatus. Hereby, the necessary pipe connections between dosing unit and valves may still be kept rather short.

Figure 3:
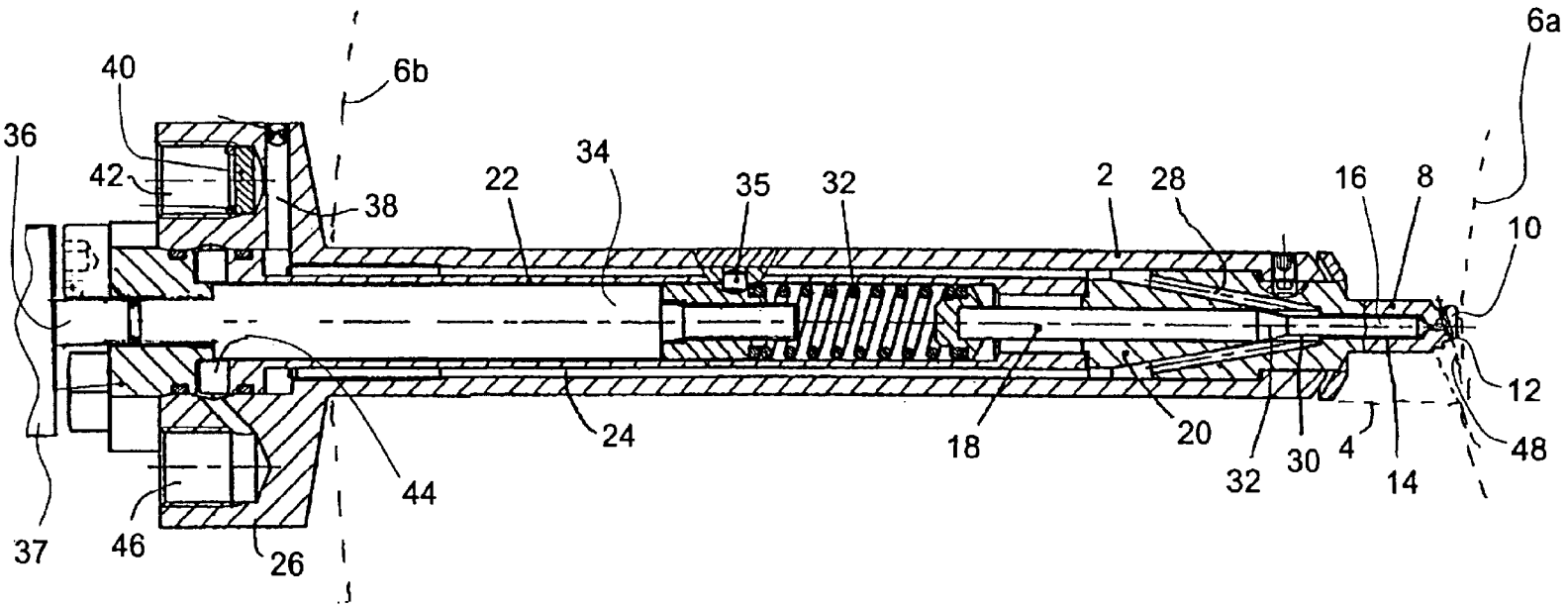
FIG. 3 shows a partial section through a further embodiment for a valve for use in a dosing unit.

The unit shown in FIG. 3 comprises an elongate, thin outer pipe 2 intended for inserting in a punctuated outlined transverse boring 4 in a cylinder wall, which is delimited between punctuate curved lines 6*a* and 6*b*. At the inner wall 6*a* of the cylinder, this pipe is terminated with an inserted nozzle plug 8 which has its mouth in a nozzle projection 10 with an outer inclining nozzle duct 12 for atomising pressurised oil which is supplied through a central access duct 14.

In this duct 14, an outer end part 16 of a valve needle 18 is accommodated, the needle 18 being axially guided in a block part 20 fastened to an inner pipe 22 which extends out through the whole outer pipe 2 at a certain radial distance therefrom, so that a cylindrical annular duct 24 is delimited between these pipes. This annular duct is used for leading the pressurised oil from a connection housing 26 just outside the outer wall 6*b* of the motor cylinder to the block part 20 in which there is formed inclining ducts 28 that may lead the pressurised oil downward and onward for communicating with a compartment 30 in front of a thickening 32 on the valve needle 18. Hereby, supplied pressurised oil may exert a back pressure force on the valve needle.

At the rear, the valve needle 18 is abutting on a compression spring 32 which is embedded in the inner pipe 22 and supported at the front end of a cylindrical slide 34 longitudinally sliding in the inner pipe 22 in which it may be adjusted to and fro by means of a screw 36 at the rear of the block part 26, where the screw is capable of being rotated by the motor 37. The slide 34 is arrested against rotation by means of a guide 35. The cylindrical duct 24 in the block part 26 is connected to a radial duct 38 which is connected via a filter 40 to a pipe connection 42 for pressurised oil. The inner side of the inner tube 22 is connected via a connection 44 with a second pipe connection 46, namely for draining off leak oil which may penetrate back from the area of the nozzle end through the inner pipe in which no special sealings occur.

The spring 32 is kept under suitable preload corresponding to the desired opening pressure for the valve needle, and when the oil pressure on the connection 42 is built up to this level, the valve needle will be forced a little bit backwards via the oil pressure upon the needle thickening 32, so that the valve needle point leaves its seat contact at the end of a narrow duct out to the nozzle duct 12 and thereby right from the start of the opening induces high pressure atomisation of the oil ejection designated 48 from the nozzle. This situation is maintained until there is initiated a pressure reduction of the supplied oil whereby the atomisation of the nozzle is abruptly terminated.

It will appear that the whole pipe part may appear with a relatively small diameter, that the supply and discharge ducts for pressurised oil and lead oil, respectively, do not require any particular cutting operation, except for the external inclining ducts 28, that the spring 32 very well may be disposed in the inner pipe 22, and that the block part 20 may occur with small size due the fact, among others, that it is not to contain the spring 32.

In FIG. 3, the nozzle is shown with a radial orientation through the cylinder wall 6*a*, 6*b*. Alternatively, the nozzle may be oriented under an inclining angle relative to a radian. This depends on space conditions, material thickness etc.

It is to be mentioned that the supply of pressurised oil may alternatively be established via one or more longitudinal grooves in either the outer pipe 2 or the inner pipe 22, which will imply the same facilitation of production as previously discussed.

What is claimed is:

1. A dosing system for cylinder lubricating oil for large diesel engine cylinders in an engine with a supply pipe and a return pipe provided with each their valve (3, 27) and connected with a central supply pump, and with a number of injection units corresponding to the number of cylinders in the engine and connected with the pipes, each of which units comprising:

an injection nozzle for injecting atomised cylinder lubricating oil into an associated cylinder, a piston (1) placed at the rear end of a nozzle rod, and a controllable motor (37) abutting on the piston (1) via a screw (33,36) in order thereby to adjust the pump stroke of the piston (1), which system also comprises a central computer for controlling the valves (3,27) and the motor (37).

2. A system according to claim 1, wherein the nozzle comprises a cylindrical nozzle rod (2) for fitting through a hole (4) in the cylinder wall, the nozzle rod having a central passage (14) for a needle valve body (18) which is spring loaded in outward direction for closing an inner valve seat in a nozzle outlet of the nozzle rod, and a second axial passage (24) for controlled supply of pressurised oil to a front pressure chamber (30) in which the pressurised oil may exert a backward pressing of the needle valve body for opening the inner valve seat as well as an overpressure injection of oil through the nozzle opened thereby until the oil pressure is lowered for effective closing of the needle valve, where the central passage is constituted by an annular cylindrical space (24) between an outer tubular cylindrical nozzle rod (2) and a centrally placed through-going pipe (22) for central accommodation of the needle valve body (18).

3. A system according to claim 1, wherein the piston (1) is loaded by a spring (1') urging the piston towards an oil supply compartment (5) when the system is without pressure.

4. A system according to claim 1, wherein the nozzle (11) is provided with an outer inclining nozzle duct (12).

5. A system according to claim 1, wherein the injection nozzle and the controllable motor are disposed concentrically about a common axis.

6. A system according to claim 2, wherein the spring (32) acting on the needle valve body is abutting on a longitudinally displaceable slide (34), the stroke of which is determined by the controllable motor (37).

7. A system according to claim 6, wherein the slide (34) is held rotationally fixed by a guide (37).

8. A system according to claim 2, wherein the spring (32) acting on the needle valve body has a preload corresponding to the desired opening pressure for the valve needle (18).

* * * * *